US005489102A

United States Patent [19]

Hawkins

[11] Patent Number: 5,489,102

[45] Date of Patent: Feb. 6, 1996

[54] ARROW POINT FOR SMALL GAME

[76] Inventor: John P. Hawkins, 56 N. Edwards St., Franklin, Ind. 46131

[21] Appl. No.: 437,030

[22] Filed: May 8, 1995

[51] Int. Cl.[6] ..... F42B 6/08

[52] U.S. Cl. ..... 273/422; 273/419

[58] Field of Search ..... 273/419–422, 273/416

[56] References Cited

U.S. PATENT DOCUMENTS

| | | | |
|---|---|---|---|
| 2,289,284 | 7/1942 | Chandler | 273/422 |
| 2,829,894 | 4/1958 | Henkel | 273/422 |
| 2,876,760 | 3/1959 | Halverson | 273/421 X |
| 2,905,470 | 9/1959 | Hoyt, Jr. | 273/421 X |
| 2,909,372 | 10/1959 | Neri | 273/422 |
| 2,912,247 | 11/1959 | Doonan | 273/422 |
| 2,940,758 | 6/1960 | Richter . | |
| 3,398,960 | 8/1968 | Carroll, Jr. | 273/422 |
| 3,614,103 | 10/1971 | Carroll | 273/422 |
| 3,618,948 | 11/1971 | McGlocklin | 273/422 X |
| 3,854,723 | 12/1974 | Wilson | 273/420 |
| 4,210,330 | 7/1980 | Kosbab . | |
| 4,254,958 | 3/1981 | Bateman, III | 273/421 |
| 4,410,184 | 10/1983 | Anderson . | |
| 4,643,435 | 2/1987 | Musacchia . | |
| 4,986,550 | 1/1991 | Segovia . | |
| 5,018,747 | 5/1991 | Brown . | |
| 5,145,187 | 9/1992 | Lewis . | |
| 5,160,148 | 11/1992 | Musacchia, Sr. . | |
| 5,192,081 | 3/1993 | Cooper . | |
| 5,354,068 | 10/1994 | Maleski . | |

OTHER PUBLICATIONS 1991 fall issue of *Cabelas* catalog, pp. 176 and 177.

*Primary Examiner*—Paul E. Shapiro

*Attorney, Agent, or Firm*—Woodard, Emhardt, Naughton Moriarty & McNett

[57] ABSTRACT

An arrow point for small game includes a point body which may be styled as either a blunt point or a field point and which is slotted through its distal end so as to receive a bleeder blade. The slot which is machined into the distal end of the point body has a substantially uniform slot width and defines a bottom surface. The bleeder blade which is installed into the point body is designed to be replaceable and to assemble to the point body with an interference fit. The bleeder blade includes a pair of oppositely disposed cutting edges and has a substantially centered relief notch defining an upper edge. The bleeder blade has a substantially uniform thickness which is dimensioned so as to create a line-to-line or slight interference fit in the point body slot. The bleeder blade is assembled in the point body such that the relief notch is aligned with the slot such that the bottom surface of the slot contacts the upper edge of the bleeder blade notch and the distal end of the point body axially protrudes beyond the bleeder blade.

14 Claims, 4 Drawing Sheets

ARROW POINT FOR SMALL GAME

BACKGROUND OF THE INVENTION

The present invention relates in general to arrow points for archery as well as hunting. More specifically, the present invention relates to the use of blunt points and field points and the option of converting these points to a type of broadhead arrow with bleeder blades.

A primary type or style of arrow point is referred to as a "broadhead" and the catalog literature is filled with examples of broadheads as shown by pages 176 and 177 of the 1991 fall issue of the Cabelas catalog. A variety of broadheads are disclosed and while there are some variations, a typical broadhead includes a pointed tip, a body portion, and razor-sharp blades which are sometimes referred to as bleeder blades. An arrangement of slots, threads, and a locking mechanism enable the bleeder blades to be arranged around the body portion between the pointed tip and the shaft of the arrow.

In addition to the variety of broadheads in the Cabelas catalog, a number of issued patents disclose broadhead designs. A representative sampling of such patented designs is provided by the following listed patents:

| PATENT NO. | PATENTEE | ISSUE DATE |
|---|---|---|
| 2,940,758 | Richter | Jun. 14, 1960 |
| 4,210,330 | Kosbab | Jul. 1, 1980 |
| 4,410,184 | Anderson | Oct. 18, 1983 |
| 4,643,435 | Musacchia | Feb. 17, 1987 |
| 4,986,550 | Segovia | Jan. 22, 1991 |
| 5,018,747 | Brown | May 28, 1991 |
| 5,145,187 | Lewis | Sep. 8, 1992 |
| 5,160,148 | Musacchia, Sr. | Nov. 3, 1992 |
| 5,192,081 | Cooper | Mar. 9, 1993 |
| 5,354,068 | Maleski | Oct. 11, 1994 |

Broadhead arrow heads are normally used for hunting larger game as the size, shape, and sharpness of the bleeder blades can do substantial damage, depending to some extent on the hit location. As might be apparent due to the razor-sharp edges oil the bleeder blades, broadheads are not used for target practice. The sharply pointed tip also makes broadheads inappropriate for hunting small game. Small game such as groundhogs, rabbits, raccoons, opossums, and squirrels are normally found at ground level or in the case of raccoons, opossums and squirrels, in trees. Shooting a broadhead toward the ground can do little more than cause damage to the broadhead if the game is missed and the arrow strikes a rock or stone or some other hard surface which may be found at ground level. If a broadhead is shot into the branches of a tree and the squirrel or other small game is not hit, the arrow can become lodged in the trunk of the tree or in one of its branches. If the arrow is not reachable so as to be retrieved, it is lost to the hunter. Since broadhead arrows are relatively expensive, there are concerns over either damage to the arrow if it hits a stone or rock or being lost when stuck into a tree limb which is not otherwise reachable by the hunter. When these factors are considered, it means that broadhead arrows are not, or at least should not, be used for small game.

A preferred arrow point for small game is to use either a field point or a blunt. These styles do not include any type of razor-sharp bleeder blade and may additionally be suitable for target practice. One of the possible shortcomings with using either a field point or blunt for small game is the lower killing efficiency. Without the bleeder blades it is possible for a field point or blunt to pass through the fur and skin of the small game, and due to the smaller outside diameter of these styles of arrow heads, there may not be enough damage caused to actually kill the small game.

One advantage of using a field point or blunt is that if the arrow strikes a rock or stone, it will normally not be damaged. If the arrow is shot into the branches of a tree, there is less of a chance that the arrow will be lodged in a limb or in the trunk of the tree since the tip is not as sharply pointed as the tip of a broadhead.

In view of the reasons to use the various arrow styles which have been discussed and in view of the reasons why one would not want to use a particular style, it would be an improvement to combine the beneficial features of both categories into one arrow head which is low cost, repairable, and suitable for small game without the same concerns about damage and lost arrows. It would also be an improvement to provide a blunt or field point with a higher killing efficiency. With a higher killing efficiency, small game which may be hit but not killed with a conventional blunt or field point, will be killed resulting in less suffering to the small game. The present invention provides a unique combination of structural features combining the beneficial aspects of both categories of arrow heads into a novel and unobvious design.

SUMMARY OF THE INVENTION

An arrow point for small game according to one embodiment of the present invention comprises a substantially cylindrical point body having a distal end which defines a slot having a substantially uniform slot width and a slot bottom surface, the point body further having a proximal end which defines an arrow shaft-receiving bore. The arrow point further comprises a replaceable bleeder blade having a pair of oppositely disposed cutting edges and defining a substantially centered relief notch having an upper edge, the bleeder blade having a substantially uniform thickness, the bleeder blade being assembled into the point body such that the relief notch is aligned with the slot and the bottom edge contacts the upper edge whereby the distal end of the point body axially protrudes beyond the bleeder blade.

One object of the present invention is to provide an improved arrow point for small game.

Related objects and advantages of the present invention will be apparent from the following description.

DESCRIPTION OF THE PREFERRED EMBODIMENT

Figure 1:
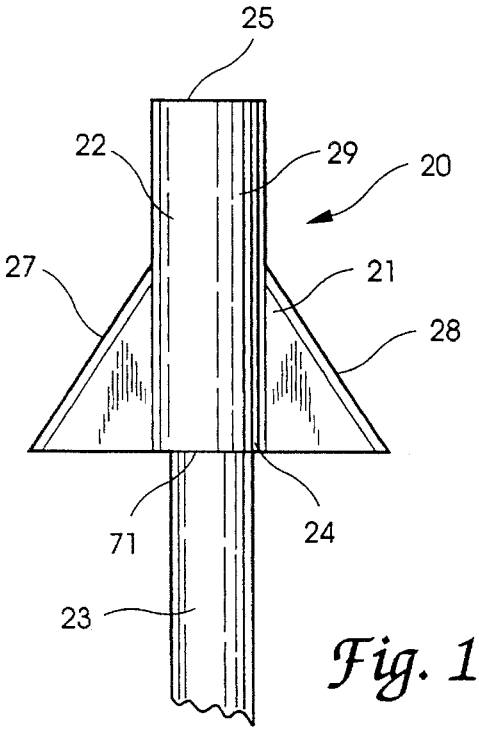
FIG. 1 is a front elevational view of a blunt point arid bleeder blade combination according to a typical embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1 there is illustrated a modified blunt arrow head 20 which includes a replaceable bleeder blade 21 which is slideably received in blunt point 22 according to the present invention. The shaft 23 of the arrow is partially illustrated and is securely received up into the lower or proximal end 24 of the blunt point 22. The blunt point is generally cylindrical and its receiving bore for the arrow shaft is substantially concentric with the outside diameter of the blunt point. The distal end 25 is substantially flat and normal to the longitudinal axis of the arrow head 20. The bleeder blade 21 includes razor-sharp edges 27 and 28 which extend out from the outside diameter surface 29 of the blunt point 22. Bleeder blade 21 is designed so as to be substantially symmetrical with respect to blunt point 22.

Figure 2:
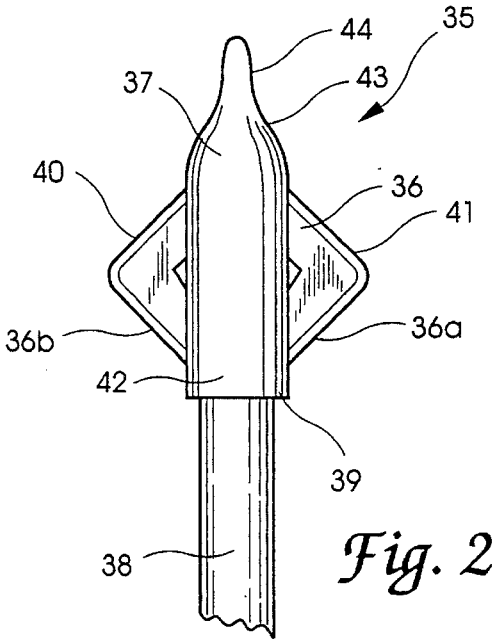
FIG. 2 is a front elevational view of a field point in combination with a bleeder blade according to a typical embodiment of the present invention.
Figure 2A:
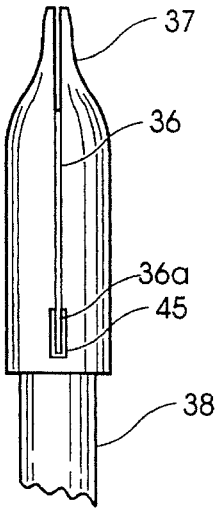
FIG. 2A is a partial side elevational view of the FIG. 2 combination according to the present invention.

Referring to FIGS. 2 and 2A there is illustrated a modified field point arrow head 35 which includes a replaceable bleeder blade 36 which is slideably received in field point 37 according to the present invention. The shaft 38 of the arrow is partially illustrated and is securely received up into the lower or proximal end 39 of the field point 37. The field point is generally cylindrical except for the tapered portion of its distal end. The receiving bore for the arrow shaft is substantially concentric with the outside diameter surface of the field point body. The bleeder blade 36 includes razor-sharp edges 40 and 41 which extend out from the outside diameter surface 42 of the field point 37. Field point 37 includes a tapered tip 43, ending with a pointed distal portion 44. Bleeder blade 36 is designed so as to be substantially symmetrical with respect to field point 37.

Figure 10:
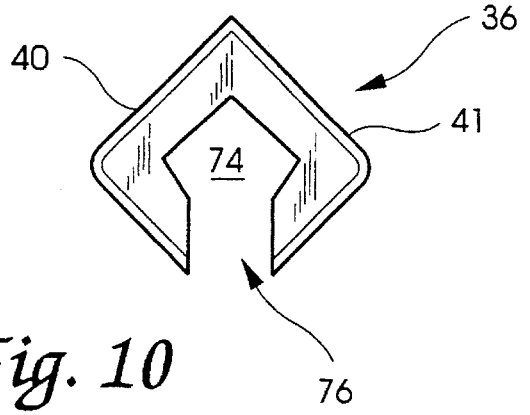
FIG. 10 is a front elevational view of a bleeder blade suitable for use in either the FIG. 1 or FIG. 2 combination according to the present invention.

As will be understood from a review of the FIG. 10 bleeder blade illustration, the lower edges 36*a*, 36*b* of blade 36 abut up against the outer, generally cylindrical surface 42 of field point 37. In order to secure and stabilize the bleeder blade 36 relative to field point 37, two small indentations 45 (see FIG. 6), located 180 degrees apart, are formed down into surface 42. Each indentation 45 receives one of the two lower edges 36*a* or 36*b* of blade 36 and each indentation has a length and width which is very close to (slightly larger than) the size of each lower edge. This sizing ensures that each lower edge of blade 36 actually snaps into its corresponding indentation 45 for locking the blade to the point.

Blunt point 22 and field point 37 represent typical configurations except for the fact that they are uniquely slotted to receive one of various bleeder blade designs. By placing the bleeder blades away from the most distal end or portion, the bleeder blades will be protected to some degree. If either style of point happens to strike a rock or stone, while shooting at small game at ground level, the arrow should deflect so as to normally spare the more fragile edges of the bleeder blade. If the hunter wishes to use either the blunt point 22 or the field point 37 without a bleeder blade, then those points may be used in their normal manner and if already assembled with a bleeder blade, the blade can be removed. As a consequence, the styles of FIGS. 1 and 2 are convertible between a normal blunt point or field point and a blunt point or field point which is modified with a bleeder blade. This convertibility can be achieved at any time by the hunter, even when in the woods or a field.

While the protruding distal end of the point should be the first point of contact, damage may still occur to the bleeder blades. Such damage might be the result of the arrow deflecting and ricocheting off of other rocks or stones. However, even if damage does occur to the bleeder blade, it can be pulled out of the corresponding point (either blunt or field) and a new bleeder blade inserted. The configurations which enable the bleeder blades to be replaceable in the illustrated blunt point 22 arid field point 37 are illustrated in FIGS. 3–8.

Figure 3:
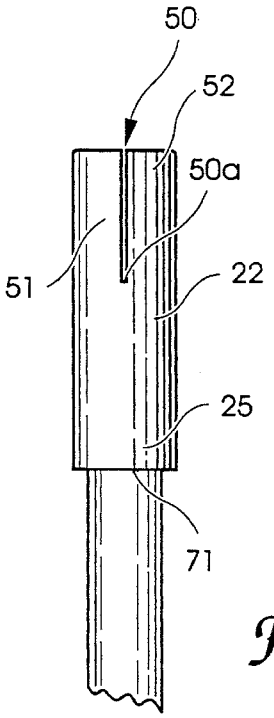
FIG. 3 is a front elevational view of the FIG. 1 blunt point turned 90 degrees from the FIG. 1 orientation.

FIG. 3 illustrates the construction of blunt point 22 as turned 90 degrees from its FIG. 3 orientation. This view thus reveals slot 50 which is used to receive bleeder blade 21. Slot 50 which is relatively narrow and of a uniform width extends completely through the distal end of the blunt point 22 on a diameter line so as to be precisely centered. The bottom surface 50*a* of slot 50 provides an abutment surface for the bleeder blade. The width of slot 50 is approximately 0.018 inches while the thickness of bleeder blade 21 ranges between 0.018 inches and 0.020 inches. These various dimensions create a slight interference fit of the bleeder blade 21 in the blunt point 22. This slight interference fit is sufficient to hold the bleeder blade securely in position through normal use and travel of the arrow. Proper installation of bleeder blade 21 occurs when the upper edge of its relief notch comes in contact with the bottom surface 50*a* of slot 50. At any time thereafter the bleeder blade can be removed by forcibly pulling it out of slot 50. Installing the bleeder blade 21 or a new bleeder blade is possible even with the described interference fit due to the slight "give" in side portions 51 and 52 due to the machining of slot 50 through the distal end.

Figure 4:
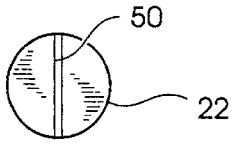
FIG. 4 is a top plan view of the FIG. 3 blunt point.
Figure 5:
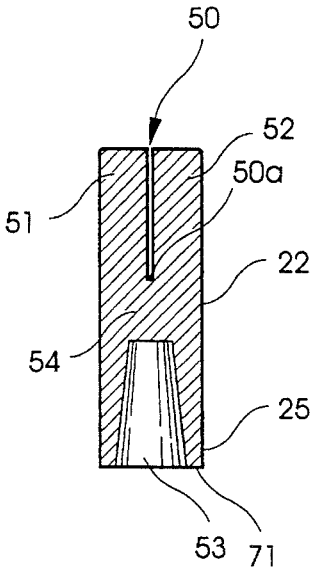
FIG. 5 is a front elevational view in full section of the FIG. 3 blunt point.

FIG. 4 is a top plan view illustrating the centered or diametral location of slot 50 relative to the generally cylindrical body of blunt point 22. In FIG. 5 the shaft bore 53 in the lower or proximal end 25 has a slightly tapered configuration and is spaced from slot 50 by portion 54. In this way the blunt point 22 is not unnecessarily weakened by including slot 50. Enough material between bore 53 and slot 50 is retained to insure the requisite strength and rigidity to the blunt point. As an alternative to the shaft bore design illustrated in FIG. 5, the blunt point 22 could be configured with a smaller diameter stem which is externally threaded such that the blunt point would then screw into the internally threaded end of the arrow shaft.

Figure 7:
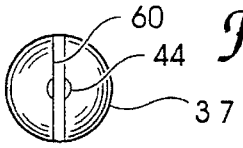
FIG. 7 is a top plan view of the FIG. 6 field point.
Figure 6:
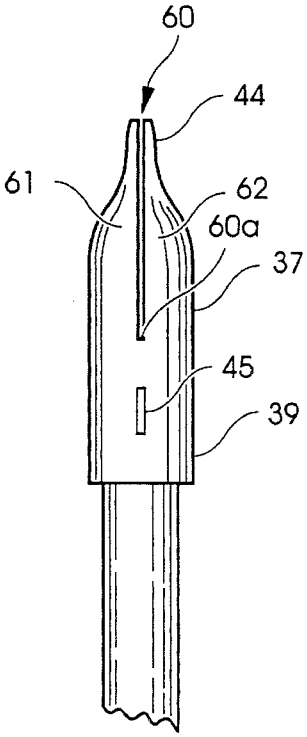
FIG. 6 is a front elevational view of the FIG. 2 field point turned 90 degrees from the FIG. 2 orientation.
Figure 8:
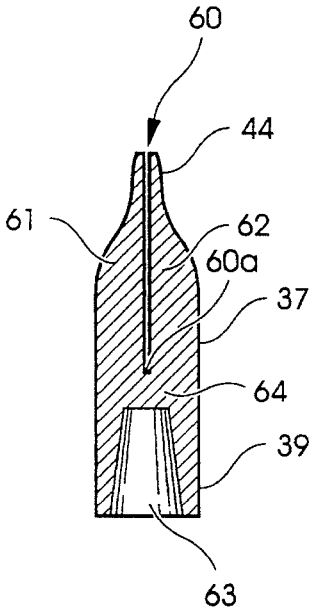
FIG. 8 is a front elevational view in full section of the FIG. 6 field point.

Referring now to FIGS. 6–8, the more detailed construction of field point 37 is illustrated. FIG. 6 illustrates the construction of field point 37 as turned 90 degrees from its FIG. 2 orientation. The view reveals slot 60 which is used to receive bleeder blade 36. Slot 60 which is relatively narrow and of a uniform width extends completely through the distal end of the field point 37 on a diameter line so as to be precisely centered. The bottom surface 60*a* of slot 60 provides an abutment surface for the bleeder blade. The width of slot 60 is approximately 0.018 inches while the thickness of bleeder blade 36 ranges between 0.018 inches and 0.020 inches. These dimensions create a slight interference fit of the bleeder blade 36 in the field point 37. This slight interference fit in combination with the snap fit of the blade edges into indentations 45 is sufficient to hold the bleeder blade securely in position through normal use and travel of the arrow. Proper installation of bleeder blade 36 occurs when the upper edge of its relief notch comes in contact with the bottom surface 60*a* of slot 60. At any time thereafter the bleeder blade can be removed by forcibly pulling it out of slot 60 and concurrently freeing the two blade lower edges from the two indentations. Installing the bleeder blade 36 or a new bleeder blade is possible even with an interference fit due to the "give" in side portions 61 and 62 which are created by machining slot 60 through the distal end.

FIG. 7 is a top plan view illustrating the centered or diametral location of slot 60 relative to the generally cylindrical body of field point 37. In FIG. 8 the shaft bore 63 in the lower or proximal end 39 has a slightly tapered configuration and is spaced from slot 60 by portion 64. In this way the field point 37 is not unnecessarily weakened by including slot 60. Enough material between bore 63 and slot 60 is retained to insure the requisite strength and rigidity to the field point. As an alternative, bore 63 may be eliminated and the proximal end of the field point arranged with a smaller diameter stem which is externally threaded for receipt by the internally threaded mating tip of the arrow shaft.

Figure 9:
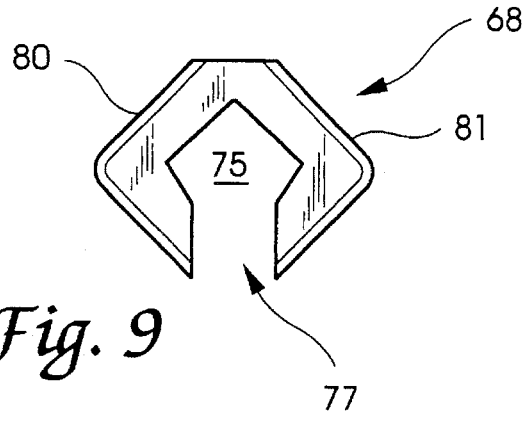
FIG. 9 is a front elevational view of a bleeder blade suitable for use in either the FIG. 1 or FIG. 2 combination according to the present invention.
Figure 9A:
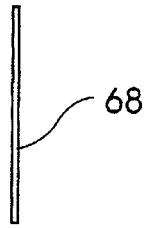
FIG. 9A is a side elevational view of the FIG. 9 bleeder blade.
Figure 10A:
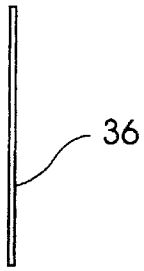
FIG. 10A is a side elevational view of the FIG. 10 bleeder blade.
Figure 11:
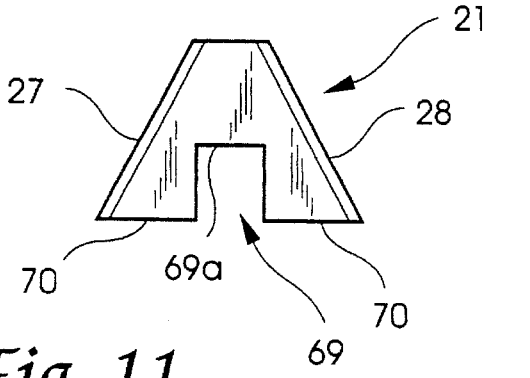
FIG. 11 is a front elevational view of a bleeder blade suitable for use in either the FIG. 1 or FIG. 2 combination according to the present invention.
Figure 11A:
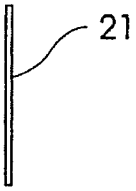
FIG. 11A is a side elevational view of the FIG. 11 bleeder blade.

Referring to FIGS. 9–11, various bleeder blade styles are illustrated including bleeder blade 21 (FIG. 11) and bleeder blade 36 (FIG. 10). The FIG. 9 style of bleeder blade 68 is similar to FIG. 10 except that the forwardmost tip or point is modified by being removed leaving a flat forward edge. As illustrated in FIGS. 9A, 10A, and 11A, each bleeder blade 21, 36, and 68 is substantially flat on both sides with a relatively uniform thickness throughout which is between 0.018 inches and 0.020 inches. Further, each bleeder blade is arranged with a relief notch or centered clearance region for proper interfit with the corresponding slot in the selected point.

Bleeder blade 21 is relieved with a substantially rectangular center notch or opening 69 and converging razor-sharp edges 27 and 28. Opening 69 is symmetrically centered between edges 27 and 28 and the length or depth of the opening 69 up into the body portion of bleeder blade 21 is sufficient so as to cooperate with the depth of slot 50 to create the blunt arrow head of FIG. 1. The upper edge 69*a* of opening 69 abuts up against the bottom surface of the cooperating slot in the selected point. The cooperating slot/notch depths typically place the lower edges 70 of blade 21 even with the distal end surface 71 of the blunt point 22. Depending on the actual slot depths there may be some extension of the blade beyond end surface 71. Similarly, if the axial height of the blunt point is shortened, the blade edges 70 may extend beyond end surface 71.

Bleeder blade 21 may be used with glue-on points and with screw-in points even though there may be a difference in the axial height or length between these two point styles. This versatility is due to the configuration of opening 69 and the style (shape) of the lower blade edges 70. As for bleeder blades 36 and 68, these two styles are most appropriately used on glue-on point styles. The blade shapes and the design of openings 76 and 77 relative to the shorter style of screw-in points primarily dictate this more limited versatility.

Bleeder blades 36 and 68 have similar styling in center relief areas 74 and 75, respectively. The razor-sharp edges 40 and 41 of blade 36 are triangularly shaped and are symmetrically styled on opposite sides of relief area 74. Openings 76 and 77 are each just wide enough to clear the generally cylindrical side of field point 37 (or blunt point 22) so as to create the FIG. 2 configuration. In both of the illustrated assemblies, the distal end of the point axially extends beyond the bleeder blade so that the point is the first portion struck if the arrow hits a stone or rock.

Figure 12:
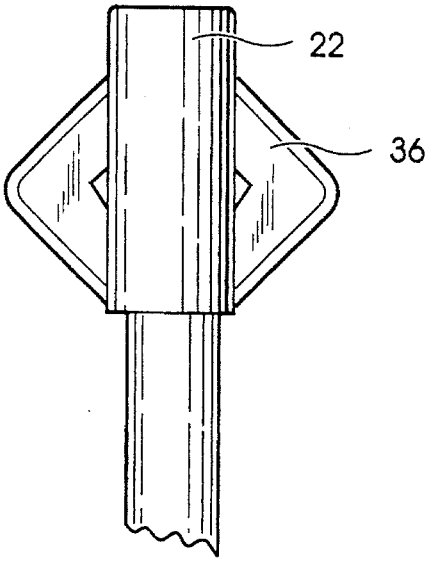
FIG. 12 is a front elevational view of a blunt point and bleeder blade combination according to a typical embodiment of the present invention.
Figure 13:
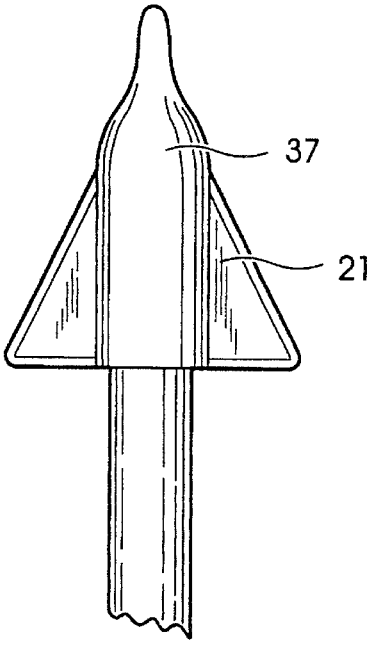
FIG. 13 is a front elevational view of a field point and bleeder blade combination according to a typical embodiment of the present invention.

Bleeder blade 68 includes generally triangular razor-sharp edges 80 and 81 which are symmetrically styled on opposite sides of relief area 75. Opening 77, as mentioned, is just wide enough to clear the generally cylindrical side of either blunt point 22 or field point 37. At this point it should be noted that any of the three illustrated bleeder blades 21, 36, or 68 are suitable for use in either style of point, either blunt point 22 or field point 37. Further, other bleeder blade designs are contemplated and would also be compatible, assuming that they include the necessary relief and thickness dimensions for the selected point. As an example of this described versatility, FIG. 12 illustrates the assembly of bleeder blade 36 into blunt point 22 and FIG. 13 illustrates the assembly of bleeder blade 21 into field point 37.

Figure 14:
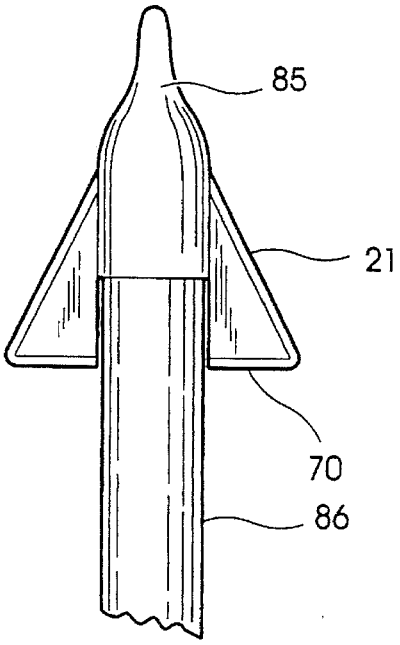
FIG. 14 is a front elevational view of a screw-in point in combination with the FIG. 11 bleeder blade according to the present invention.

With reference to FIG. 14, another embodiment of the present invention is illustrated. FIG. 14 is a combination of the FIG. 11 bleeder blade 21 with a screw-in point 85. The shorter cylindrical body length of the screw-in point as compared to a glue-on point results in the lower portion of the blade adjacent the lower edges 70 extending down around the arrow shaft 86. While the outside diameter of arrow shaft 86 may be the same diameter as the body of the screw-in point, this will not necessarily always be true. Often the diameter of the arrow shaft 86 will be a little smaller than the outside diameter of the screw-in point. In these situations, there will be a slight separation between the blade and the arrow shaft on each side, these locations of separation being 180 degrees apart. This is the configuration which is illustrated in FIG. 14.

It is also contemplated that the specific style of point may change and still be suitable for use as part of the present invention. Slight variations in the sizes and shapes of the points and blades described herein are contemplated within the scope of this invention. Some of the keys to the disclosed invention are the narrow slot in the point style and the notch relief in the blade. Also important are the slot width relative to the thickness of the blade. Finally, the various dimensions of the point and of the inserted blade need to be compatible with each other such that the final assembled configuration, typical of FIGS. 1, 2, 12, and 13 can be achieved.

The bleeder blades are made of plain steel for sharpening purposes and the cutting edges are designed to quickly subdue an animal. Without the bleeder blades, the blunt point or field point would not have the same animal-killing efficiency. If a true broadhead arrow is used for small game there is an increased likelihood of damage or the arrow may be stuck in a tree limb or trunk and unable to be retrieved. The problems of using conventional broadheads for small game and the lower killing efficiency of blunt points and field points has already been discussed. What the present invention offers is a unique combination whereby a blunt or field point retains its beneficial features while having an increased killing efficiency. The bleeder blades which are used are mounted differently from a conventional broadhead and are to some extent protected from stone or rock damage. The present invention which has been described can be mounted on any hunting arrow by conventional means, whether by the bore in the proximal end of the point or by a threaded stem. The higher killing efficiency afforded by the present invention, as compared to a conventional blunt or field point, is not only more humane for the animal but permits a higher recovery rate of the game and of the arrow. Broadheads are expensive and can be very dangerous when hunting small game, especially to other members of the hunting party. The weight of the new point according to the present invention will be approximately the same weight as a broadhead and thus there would be no difference in the flight or speed of the arrow.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An arrow point for small game comprising:

a substantially cylindrical point body having a distal end which defines a slot having a substantially uniform slot width and a slot bottom surface and a proximal end defining means for securing the point body to an arrow shaft; and a replaceable bleeder blade having a pair of oppositely disposed cutting edges and defining a substantially centered relief notch having an upper edge, said bleeder blade having a substantially uniform thickness, said bleeder blade being assembled into said point body such that said relief notch is aligned with said slot and said bottom surface contacts said upper edge whereby the distal end of said point body axially protrudes beyond said bleeder blade.

2. The arrow point of claim 1 wherein said point body is a blunt point.

3. The arrow point of claim 2 wherein said cutting edges are substantially triangular in shape.

4. The arrow point of claim 3 wherein the slot width and blade thickness create an interference fit.

5. The arrow point of claim 1 wherein said point body is a field point.

6. The arrow point of claim 5 wherein said cutting edges converge toward the distal end of said point body.

7. The arrow point of claim 6 wherein the slot width and blade thickness create an interference fit.

8. An arrow point for small game comprising:

a point body having a distal end which defines a slot having a slot width and a slot bottom surface and a proximal end defining means for securing the point body to an arrow shaft; and a bleeder blade having a pair of oppositely disposed cutting edges and defining a relief notch having an upper edge, said bleeder blade having a thickness suitable to fit within said slot, said bleeder blade being assembled into said point body such that said relief notch is aligned with said slot and said bottom surface contacts said upper edge whereby the distal end of said point body axially protrudes beyond said bleeder blade.

9. The arrow point of claim 8 wherein said point body is a blunt point.

10. The arrow point of claim 9 wherein said cutting edges are substantially triangular in shape.

11. The arrow point of claim 10 wherein the slot width and blade thickness create an interference fit.

12. The arrow point of claim 8 wherein said point body is a field point.

13. The arrow point of claim 12 wherein said cutting edges converge toward the distal end of said point body.

14. The arrow point of claim 13 wherein the slot width and blade thickness create an interference fit.

* * * * *

UNITED STATES PATENT AND TRADEMARK OFFICE

CERTIFICATE OF CORRECTION

PATENT NO. : 5,489,102

DATED : February 6, 1996

INVENTOR(S) : John P. Hawkins

It is certified that error appears in the above-indentified patent and that said Letters Patent is hereby corrected as shown below:

In Col. 1, at line 42, replace "oil" with --on--.

In Col. 2, at line 51, replace "arid" with --and--.

In Col. 4, at line 42, replace "arid" with --and--.

Signed and Sealed this

Eleventh Day of February, 1997

*Attest:*

*Attesting Officer*

BRUCE LEHMAN

*Commissioner of Patents and Trademarks*